US008915995B2

(12) United States Patent
Krafft et al.

(10) Patent No.: US 8,915,995 B2
(45) Date of Patent: Dec. 23, 2014

(54) HIGH-PERFORMANCE COATED MATERIAL FOR PAVEMENT AND A ROAD SURFACE

(75) Inventors: Serge Krafft, Irigny (FR); Francois Olard, Lyons (FR)

(73) Assignee: Eiffage Travaux Publics, Neuilly sur Marne (FR)

( * ) Notice: Subject to any disclaimer, the term of this patent is extended or adjusted under 35 U.S.C. 154(b) by 106 days.

(21) Appl. No.: 13/638,207

(22) PCT Filed: Mar. 22, 2011

(86) PCT No.: PCT/FR2011/050585

§ 371 (c)(1), (2), (4) Date: Sep. 28, 2012

(87) PCT Pub. No.: WO2011/124799

PCT Pub. Date: Oct. 13, 2011

(65) Prior Publication Data

US 2013/0022737 A1 Jan. 24, 2013

(30) Foreign Application Priority Data

Apr. 6, 2010 (FR) ..... 10 52595

(51) Int. Cl.
*E01C 7/18* (2006.01)

(52) U.S. Cl.
CPC ..... *E01C 7/182* (2013.01)
USPC ..... 106/400; 427/138; 427/136; 106/285

(58) Field of Classification Search
CPC ..... C04B 26/00; B05D 5/00
See application file for complete search history.

(56) References Cited

U.S. PATENT DOCUMENTS 5,290,833 A * 3/1994 Schmanski ..... 524/71
5,759,250 A * 6/1998 Malot et al. ..... 106/281.1

FOREIGN PATENT DOCUMENTS

EP 0381903 8/1990
EP 0760386 3/1997

* cited by examiner

*Primary Examiner* — Dah-Wei D Yuan
*Assistant Examiner* — Nga Leung V Law
(74) *Attorney, Agent, or Firm* — Occhiuti & Rohlicek LLP

(57) ABSTRACT

The invention relates to coated material for the base layer of road pavement, made up of aggregate coated with a hydrocarbon binder, wherein the aggregate is more than 95 wt % of the coated material; wherein the aggregate includes a granular structure, which includes a plurality of granular fractions d/D; one intermediate fraction of which is less than 15% of the granules; wherein the hydrocarbon binder is less than 5 wt % of the coated material; wherein the coated material includes, after compacting, a void fraction of less than 8%; wherein the hydrocarbon binder is a hydrocarbon binder modified by adding polymers or oil, or modified by foaming or by emulsion, by means of which the modulus of rigidity of the coated material, once compacted, is higher than 9000 MPa.

23 Claims, 2 Drawing Sheets

Figure 2:
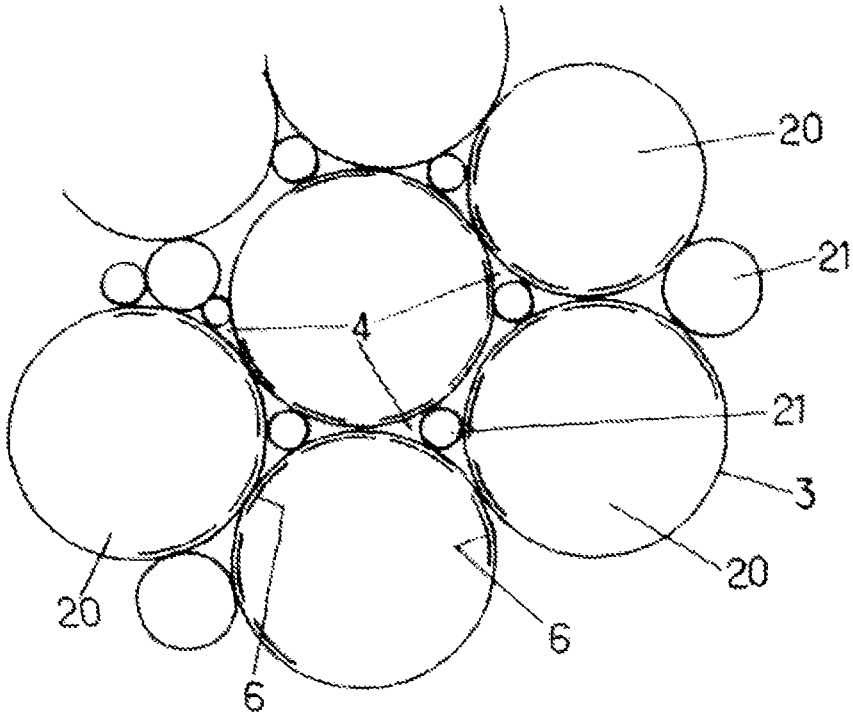

FIG.1.
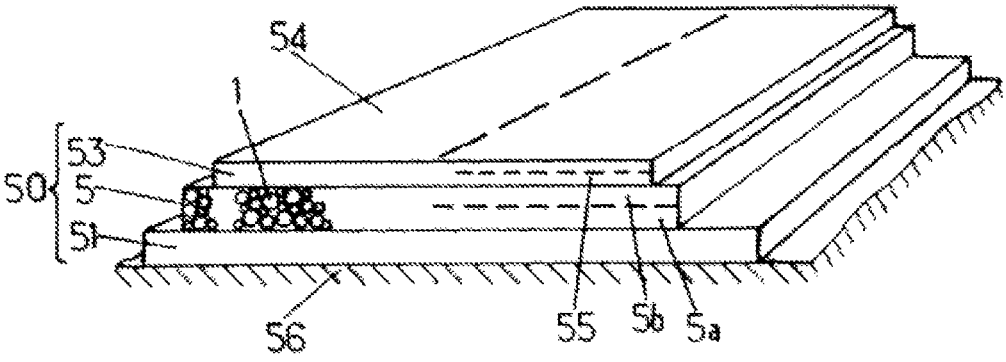
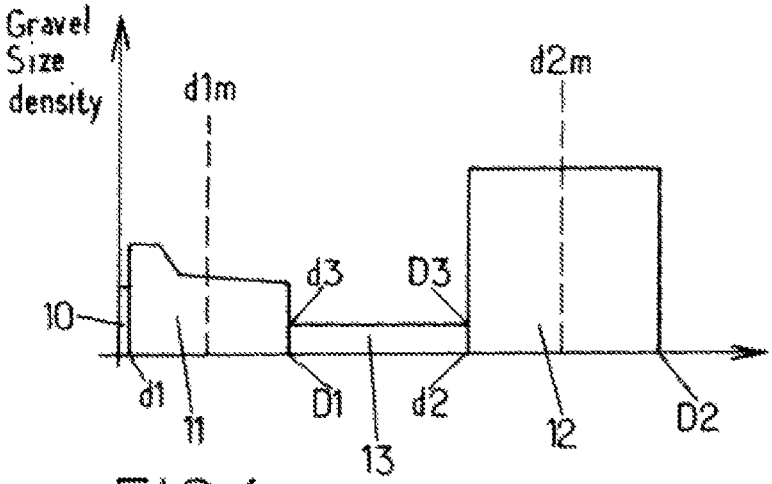
FIG.4.
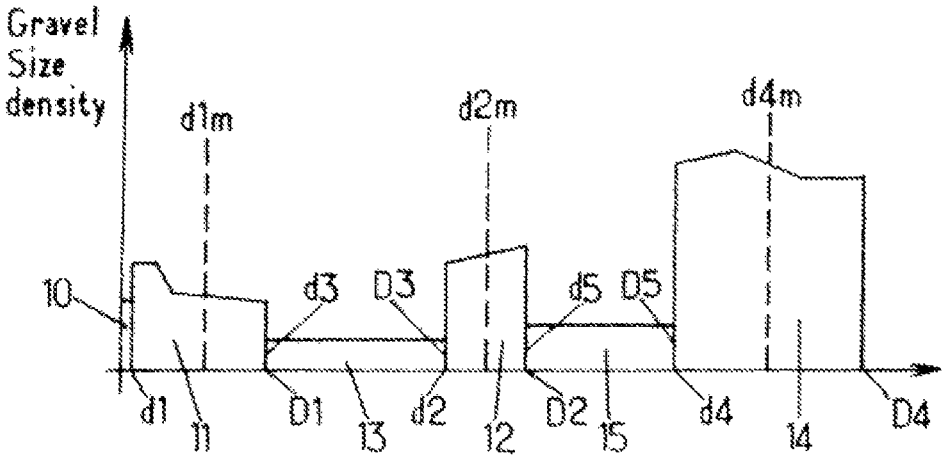
FIG.5.

HIGH-PERFORMANCE COATED MATERIAL FOR PAVEMENT AND A ROAD SURFACE

CROSS-REFERENCE TO RELATED APPLICATIONS

This application is the National Stage of International Application No. PCT/FR2011/050585, filed on Mar. 22, 2011, which claims the priority of French Application No. 1052595 filed on Apr. 6, 2010, the contents of which are incorporated herein by reference in their entirety.

The invention relates to materials for the construction of road pavement or industrial platforms, and in particular to the coated materials used to produce such surfaces. It also relates to the pavements obtained using such coated materials. Such coated materials are also known as "asphalt mixes".

More specifically, an object of the invention is a coated material intended for the production of the base layers of pavement or industrial platforms, or layers placed between the ballast and the supporting base of railroad tracks.

This base layer must combine very good mechanical properties, particularly a high modulus of rigidity, to be able to withstand high loads, and good fatigue resistance to avoid the creation and propagation of cracks and thus ensure the durability of these layers; such a coated material is obtained from aggregate and a binder, for example a bituminous binder. Known coated materials contain a significant amount of binder which leads to high costs.

In addition, the time necessary to create the base layer must be minimized as much as possible in order to decrease the time necessary for pavement repair, so that the inconvenience occasioned by pavement repair work is decreased.

It seemed worthwhile to attempt to decrease the cost of such coated materials while retaining the properties of good rigidity and fatigue resistance. It also seemed helpful to reduce the time required to lay base layers, which accelerates the return of the pavement to service.

An object of the invention is therefore a coated material for a base layer or binder layer of a road or highway pavement, or for industrial, port, or airport platforms, or for a supporting layer for railroad tracks, said coated material being composed of aggregate mixed with at least one hydrocarbon binder, wherein the aggregate represents more than 95% by weight of the coated material after compacting, and the hydrocarbon binder represents at most 5%, wherein the aggregate comprises a granular structure (skeleton) comprising several granular fractions referred to as particle size fractions d/D, each particle size fraction being defined by a lower limit (d) and an upper limit (D), wherein the aggregate comprises a first particle size fraction d1/D1, having as median a first median dm1, and a second particle size fraction d2/D2 having as median a second median dm2, wherein the aggregate comprises a third particle size fraction d3/D3 between the first and second particle size fractions, having as lower limit d3 the upper limit D1 of the first particle size fraction, and having as upper limit D3 the lower limit d2 of the second particle size fraction, wherein the third particle size fraction has a ratio of its weight ratio relative to the weight of the aggregate, this ratio being referred to as 'P3', wherein the width of the third particle size fraction D3−d3, defining a relative width (D3−d3)/D2 in relation to the upper limit (D2) of the second particle size fraction, said relative width being greater than 20% of D2, wherein the ratio between the weight ratio P3 of the third particle size fraction and its relative width is less than 0.4:

$$\frac{P3}{(D3-d3)/D2} \leq 0.4$$

by means of which the number of contacts between the particles of the second particle size fraction d2/D2 is maximized, wherein the coated material comprises, after compacting, a void content of less than 10%, possibly less than 8%, and preferably less than 6%, wherein the hydrocarbon binder is a hydrocarbon binder modified by the addition of polymers and/or oil, and/or treated by blowing and/or treated by foaming or by emulsion, by means of which the modulus of rigidity of the coated material, once compacted, is greater than 9000 MPa, and the fatigue resistance of the coated material, once compacted, is greater than 90 microstrain.

In various embodiments of the invention, one or more of the following arrangements may be used:

the ratio between the first median dm1 and the second median dm2 is less than 0.33, and preferably less than 0.25;

the width of the third particle size fraction D3−d3 is greater than 30% of D2−d1, and preferably greater than 40%;

the ratio between the weight ratio (P3) for the third particle size fraction and its relative width is less than 0.25:

$$\frac{P3}{(D3-d3)/D2} \leq 0.25$$

the ratio between the weight ratio (P3) of the third particle size fraction and its relative width is greater than 0.10:

$$\frac{P3}{(D3-d3)/D2} \geq 0.10$$

the hydrocarbon binder has a needle penetration depth, measured at 25° C. as defined in standard EN 1426, that is greater than 30 tenths of a mm;

the fatigue resistance of the coated material, once compacted, measured at a temperature of 10° C. and at a frequency of 25 Hz according to standard NF EN12697-24 in 2-point bending mode on trapezoidal test specimens, is greater than 110 microstrain and is preferably greater than 130 microstrain;

the modulus of rigidity of the coated material, once compacted, measured at a temperature of 15° C. and at a frequency of 10 Hz according to standard NF EN12697-26, is greater than 11000 MPa and is preferably greater than 14000 MPa;

the hydrocarbon binder is without fibers;

the coated material additionally comprises a fourth particle size fraction d4/D4 (14), and a fifth particle size fraction d5/D5 (15) between the second and fourth particle size fractions, having for lower limit d5 the upper limit D2 of the second particle size fraction, and having for upper limit D5 the lower limit d4 of the fourth particle size fraction, the width of the fifth particle size fraction being greater than 20% of the upper limit D4, the fifth particle size fraction (15) having a weight (P5) relative to the weight of the aggregate (2) such that $$\frac{P5}{(D5-d5)/D4} \leq 0.6$$

the proportion by weight of the hydrocarbon binder (3) in the coated material (1) is at most equal to 4.5%.

In another aspect, the invention relates to a pavement comprising at least one base layer or binder layer comprising a coated material as defined above.

In another aspect, the invention relates to a method for producing a coated material for a base layer or binder layer of a road or highway pavement, or for industrial, port, or airport platforms, or for a supporting layer for railroad tracks, said coated material being composed of aggregate mixed with at least one hydrocarbon binder, wherein the aggregate comprises a granular structure comprising several particle size fractions d/D, each particle size fraction being defined by a lower limit (d) and an upper limit (D), said method comprising the following steps, in any order:

a—providing particles from a first particle size fraction d1/D1, b—providing particles from a second particle size fraction d2/D2, said first and second particle size fractions being separated by a third particle size fraction d3/D3 having as lower limit d3 the upper limit D1 of the first particle size fraction, and having as upper limit D3 the lower limit d2 of the second particle size fraction, wherein the third particle size fraction has a ratio weight (P3) relative to the weight of the aggregate, wherein the width of the third particle size fraction D3−d3, defining a relative width (D3−d3)/D2 in relation to the upper limit (D2) of the second particle size fraction, said relative width being greater than 20% of D2, wherein the ratio between the weight ratio (P3) of the third particle size fraction and its relative width is less than 0.4:

$$\frac{P3}{(D3-d3)/D2} \leq 0.4$$

c—adding new hydrocarbon binder so as to obtain a total hydrocarbon binder of less than 5% by weight of the coated material, the hydrocarbon binder being a hydrocarbon binder modified by the inclusion of polymers and/or oil, and/or treated by blowing and/or treated by foaming and/or treated by emulsion, d—mixing all this together.

In various embodiments of the invention, one or more of the following arrangements may be used:

the first and second particle size fractions comprise a proportion of recycled aggregate, and the total hydrocarbon binder comprises a portion of new hydrocarbon binder and a portion of hydrocarbon binder issuing from recycled aggregate;

the method additionally comprises the following steps:

e—the coated material is spread on a surface, for example with at least one finisher, f—said coated material is compacted, for example with at least one compactor, by means of which the coated material comprises a void content of less than 10%, possibly less than 8%, and preferably less than 6%, and by means of which the modulus of rigidity of the coated material is greater than 9000 MPa at a temperature of 15° C. and at a frequency of 10 Hz, and the fatigue resistance of the coated material is greater than 90 microstrain at a temperature of 10° C. and at a frequency of 25 Hz.

Figure 3:
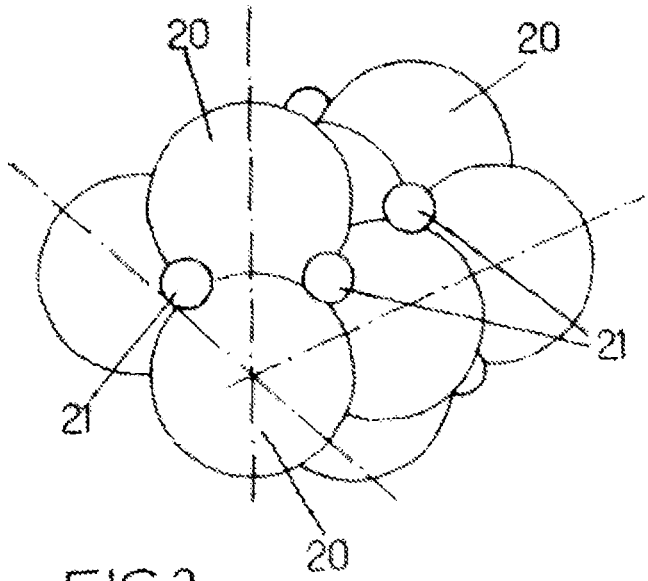

Other features, aims, and advantages of the invention will become apparent from reading the following description of several embodiments of the invention, provided as non-limiting examples. The invention will also be better understood by examining the attached drawings, in which:

FIG. 1 is a general view of a road surface comprising a base layer using a coated material of the invention, FIG. 2 is a detailed plan view of the coated material of FIG. 1, FIG. 3 is a detailed perspective view of the coated material of FIG. 1, FIG. 4 is a diagram illustrating the distribution of the dimensions of the aggregate skeleton of the coated material of FIG. 1, in first and second embodiments of the invention, FIG. 5 is a diagram illustrating the distribution of the dimensions of the aggregate skeleton in a third embodiment.

The same references are used in the different figures to denote the same or similar elements.

FIG. 1 shows a road surface 50 of the invention, having the following structure from bottom to top:

a subgrade layer 51 lying on the earth 56, a base layer 5 located above the subgrade layer 51, said base layer 5 possibly being subdivided into a sub-base 5*a* and a base course 5*b*, and a surface layer 53 located above the base layer 5 and having an upper surface able to support vehicle traffic, said surface layer possibly being subdivided into a binder layer 55 and the wearing course 54.

The road structure 50, and in particular the base layer 5, must withstand multiple stresses:

direct mechanical stress due to the moving loads of vehicle traffic, temperature-related physical stresses caused by temperature variations and the effects of ice, also called thermal stress, chemical stresses caused by fluids on the pavement, particularly rainwater, vehicle emissions (exhaust, leaking oil and other fluids), salt from deicing, and even objects or fluids unintentionally falling on the pavement.

The pavement, particularly the base layer 5, must have sufficient mechanical properties to avoid the formation of ruts and cracks and provide satisfactory durability. One objective of the base layer is therefore to present a very high modulus of rigidity and good fatigue resistance, although these two characteristics would seem to be contradictory.

The applicant has developed a coated material 1 that is particularly advantageous concerning its rigidity and fatigue resistance, while offering a very attractive cost and excellent recyclability. It is intended in particular for use in base layers 5 but is equally usable in the binder layer 55 of the surface layer 53.

This coated material 1 comprises:

aggregate 2 having a particle size distribution that is discontinuous, as will be described below, a hydrocarbon binder 3, preferably modified by the addition of polymers and/or oil, and/or treated by blowing and/or by foaming or by emulsification, which will be described below.

The particles which form the aggregate 2 are solid fragments created from new materials or recycled materials. New particles are either natural and originate from gravel pits or quarries, or artificial and originate from furnace slag for example.

Particles which come from recycling originate for example from milling road surfaces, or crushing slabs, scraps, or pieces of asphalt and excess surfacing.

The proportion of recycled particles in the aggregate 2 can vary from 0 to 100% in the invention, depending on the availability of such recycled particles.

Note that these recycled particles may be covered with the hydrocarbon binder previously used in the surface that was milled for recycling.

The particles meet, for example but not limited to, the European standards EN 13043, EN 12620, EN 13108-8.

Aggregate Skeleton

As represented in FIG. 4, the aggregate 2 comprises a distribution of particles of different sizes, usually referred to by the terms "aggregate structure" or "aggregate skeleton". The aggregate 2 includes at least three particle size fractions (d/D) 11,12,13, each particle size fraction being defined by a lower limit (d) and an upper limit (D).

A first particle size fraction d1/D1 (11) comprises small particles of a size of between d1 and D1, d1 possibly being equal to 0. If d1 is not equal to 0, then another particle size fraction 10 of between 0 and d1 is present and can contain what is usually referred to as "ultrafine" and "filler".

The first particle size fraction d1/D1 (11) has a first median dm1, defined as being the value for which 50% by weight of the particles of this fraction are smaller than dm1.

Typically, in the first embodiment of the invention, this first fraction has a lower limit d1=0.125 mm and an upper limit D1=4 mm, and its median can typically be dm1=2 mm. This first particle size fraction usually contains a large amount of sand, in which the grains have dimensions of less than 2 mm.

A second particle size fraction d2/D2 (12), called the "upper particle size fraction", comprises particles of a dimension of between d2 and D2 and having a second median dm2, defined as being the value for which 50% by weight of the particles of this fraction are smaller than dm2.

Typically, in the first embodiment of the invention, this second fraction has as a lower limit d2=10 mm and an upper limit D2=14 mm and its median can typically be dm1=12 mm. In this embodiment of the invention, D2 acts as an upper bound for the particle size limits, with the portion of particles exceeding the limit D2 being very low as defined in standards EN13043 and EN 933-1.

A third particle size fraction d3/D3 (13), called the missing or quasi-missing fraction, comprises few particles, said particles having a dimension of between d3 and D3.

Typically, in the first embodiment of the invention, this third fraction has a lower limit d3=4 mm and an upper limit D3=10 mm.

Under these conditions, for the first embodiment of the invention, the width of the third particle size fraction is Delta3=D3−d3=6 mm. It is interesting to compare it to the total width for the particles D2−0=14 mm: while the relative width (dimensionless) of the third particle size fraction is Delta3/D2=0.428 which is 42.8%. Similarly, the ratio between the first median dm1 and the second median dm2 is established at 2 mm/12 mm, which is 0.166.

The discontinuity caused in the aggregate skeleton by the third "missing" fraction can therefore be characterized by two concepts, separately or combined:

the relative width of this fraction Delta3/D2, the ratio of the medians of the adjacent fractions dm1/dm2.

Several implementations of this type of aggregate skeleton have shown that the ratio between the first median dm1 and the second median dm2 should advantageously be less than 0.33 and preferably less than 0.25. Similarly, it has been found that the relative width of the third particle size fraction (D3−d3)/D2 should be greater than 20%, preferably greater than 30%, and even more preferably greater than 40%.

In addition, the second particle size fraction represents a proportion of 40% to 60% by weight of the aggregate 2, and the first particle size fraction represents a proportion of 35% to 45% by weight of the aggregate 2, the remainder being occupied by the ultrafine particles and fillers, and by the minimal quantity that the third particle size fraction represents.

In fact, advantageously according to the first embodiment of the invention, the third particle size fraction (missing fraction) has a ratio (P3) of the weight relative to the weight of the aggregate 2, this ratio (P3) being less than 15% of the weight of the aggregate 2.

This residual quantity of particles in the "missing" fraction is in particular the result of industrial or laboratory operations of successive sieving, known to the art, which present certain imperfections or tolerances (see standard EN 933-1).

Of course, in the invention it is preferable to have a low weight ratio (P3), and it is further preferred for it to be less than 10% of the weight of the aggregate 2, and even more preferred to be less than 5% of the weight of the aggregate 2.

The applicant has determined that this weight ratio can be related to the relative width of the missing particle size fraction, by the following formula:

$$\frac{P3}{(D3-d3)/D2} \leq 0.4. \qquad \text{(Eq. 1)}$$

For the first example described in the first embodiment, this ratio is 14/42.8=0.33, as can be seen from the appended Table 1.

Preferably, when the discontinuity is more obvious, the residual weight in the missing fraction is more advantageous and is such that:

$$\frac{P3}{(D3-d3)/D2} \leq 0.25. \qquad \text{(Eq. 2)}$$

The technical effect of this ingenious distribution, characterized by one of the above equations Eq. 1 or Eq. 2, is to maximize the possibilities for mutual contact between the particles in the upper particle size fraction, as illustrated in FIGS. 2 and 3. The particles 20 of the upper particle size fraction 12 can be in contact 6 with particles 20 of the same size, because the particles of intermediate size (missing fraction) are not present or are minimally present. The small particles 21, belonging to the first particle size fraction 11, lodge in the spaces 4 between the large particles 20 without preventing the latter from coming into mutual contact.

These multiple contacts between the large particles 20 give the coating coated material a very high modulus of rigidity, despite the presence of a thin layer of binder 3 which will be detailed below. Advantageously in the invention, a coated material is obtained after compacting that has a modulus of rigidity greater than 9000 MPa, possibly greater than 11000 MPa, and preferably greater than 14000 MPa. The modulus of rigidity measurements mentioned here are generally conducted at a temperature of 15° C. and at a frequency of 10 Hz. One can refer to standard NF EN12697 26 for modulus of rigidity measurement methods. The values of the modulus of rigidity may also be determined according to standard AASHTO TP 62-03 at 70° F. and 10 Hz.

As for the discontinuity introduced by the third particle size fraction, it was also found that to avoid a known phenomenon referred to as "segregation" in which a certain separation occurs between the large particles and small particles, it can be detrimental if the third particle size fraction is completely empty. In fact, the presence of a minimal quantity of particles of intermediate size improves the uniformity of the mixture in the aggregate skeleton and avoids the segregation phenomenon, this minimal quantity being expressed by the following relation:

$$\frac{P3}{(D3-d3)/D2} \geq 0.10. \quad \text{(Eq. 3)}$$

The aggregate skeleton described above may be obtained according to successive and selective sieving processes well known in the art and not detailed here.

Table 1, appended at the end of the present Description, provides four examples of aggregate skeletons (referred to as 'HP1' to 'HP4') according to the first embodiment of the invention, compared to two controls (fifth and sixth columns). In Table 1, one can see that for the examples represented, the relative weight of the third particle size fraction (passing through sieves of 4 and 10 mm) varies between 12% and 15%, in comparison to 26-30% for the control mixes, which satisfies the relation defined by Eq. 1 and Eq. 3 above.

Hydrocarbon Binder

The hydrocarbon binder 3 comprises a main component, preferably bitumen but it could also be a mixture of equivalent long hydrocarbon chains that are synthetic or of plant origin.

The binder may also be a mixture of pitch and resin such as described in the applicant's patent applications FR07/02927 and PCT/FR2008/000556.

The hydrocarbon binder 3, also referred to as "total hydrocarbon binder", may be composed of a portion of new hydrocarbon binder and a portion of recycled hydrocarbon binder which covers the recycled particles.

Given that the good rigidity is obtained due to multiple contacts between the large particles 20, in the invention it is no longer necessary to use hard binders for the portion of new hydrocarbon binder as was done in the prior art, particularly hard grade bitumen, characterized by a needle penetration depth of less than 30 tenths of a mm as defined in standard EN 1426 (or ASTM Method D5) under standard test conditions, specifically at 25° C./77° F. These hard grade bitumens were previously the reference solution for pavements subject to severe stresses and high traffic, having a high modulus of rigidity and high fatigue resistance. However, the use of these hard binders in the prior art resulted in the following problems:

- a certain fragility in terms of heat fissuring (thermomechanical coupling in the pavement structure), and in terms of resistance to crack propagation at lower temperatures (particularly <0° C.), which could result in pavement fragility in the winter,
- fatigue resistance with such hard binders does not reach specification levels in certain cases,
- the binder content within the material is relatively high (≥5% and most often ≥5.5%) in order to partially compensate for the above two disadvantages,
- hard grade bitumens preferably originate from certain types of heavy oil and require special production; petroleum producers have developed production "recipes" which make use of sophisticated distillation units that rely on the cut points between bitumen bases,
- the industrial availability of hard grade bitumen is increasingly limited, particularly during the summer when traffic levels are very high,
- and lastly the recyclability of hard binders is limited.

The new hydrocarbon binder is mixed with the aggregate skeleton (and therefore the portion of recycled hydrocarbon binder if any) under one of the following conditions:

- at ambient temperature (generally 40° C.),
- at a moderately warm temperature (between 40° C. and 100° C.)
- at a warm temperature (between 100° C. and 140° C.),
- hot (between 140° C. and 190° C.)

Advantageously in the invention, a hard binder is not used. In the invention, the portion of new hydrocarbon binder can be judiciously modified or treated to improve its properties for the production of the coated material, by one of the following methods, as defined for example in standard EN 12597 concerning bitumen:

- the hydrocarbon binder may be "modified" by adding chemical agents belonging for example to the families of natural rubbers, synthetic polymers, organometallic compounds, sulfur and sulfides; it is preferable to use the copolymers SB (styrene butadiene), SBS (styrene-butadiene-styrene), SBS star, SBR (styrene butadiene rubber), EPDM (ethylene propylene diene monomer), polypropylene (PP), plastomers such as EVA (ethylene methyl or vinyl acetate copolymers, copolymers of olefin and unsaturated carboxylic esters), EBA (ethylene butyl acrylate), SEBS (styrene ethylene butylene styrene copolymer), or ABS (acrylonitrile-butadiene-styrene);
- note that the chemical agents mentioned above may originate from recycled aggregate, and in this case it may not be necessary to add such chemical agents as they are already present in the recycled aggregate incorporated into the aggregate skeleton,
- the hydrocarbon binder may be "oxidized" by blowing hot air, a method in which a blowing unit projects hot air onto the raw binder conveyed in front of it, this binder being commonly referred to as "industrial bitumen";
- the hydrocarbon binder may be "foamed" by injecting cold water and/or cold air under pressure;
- the hydrocarbon binder may be "emulsified" by adding an aqueous liquid, possibly supplemented with a surfactant;
- the hydrocarbon binder may be "fluxed" by adding oil.

Choosing one of the treatments from among those described above (or several in combination) contributes to the fatigue resistance of the coated material:

1—in the "modified", "oxidized", and "fluxed" cases, regardless of the production temperature and for any form (anhydrous, in emulsion, in foam), the fatigue resistance of the binder and therefore of the coated material is substantially increased, 2—in the "foamed" and "emulsified" cases, at a reduced manufacturing temperature (only ambient, moderately warm, or warm temperatures as defined above are considered), this contributes to decreasing the aging of the binder which contributes indirectly to better fatigue resistance and greater durability of the binder and therefore of the coated material.

As pure bitumens are excluded for the above reasons, we are interested in binders having a needle penetration depth greater than 30 tenths of a mm (pen) as defined in standard EN 1426 (or ASTM Method D5) under the standard test conditions, specifically 25° C./77° F. This level of penetration (≥30 pen) ensures excellent recyclability of the binder over the long term.

The appended Table 6 gives the main properties of binders used in the illustrated examples of the invention.

A certain amount of new hydrocarbon binder prepared in this manner is mixed at a manufacturing plant with the aggregate skeleton defined above, to obtain an amount of at most 5.25% by weight of the aggregate 2, taking into account the binder fraction already present in the recycled aggregate. In this manner a coated material is obtained containing at least 95% by weight of particles and at most 5% by weight of hydrocarbon binder 3, preferably 4.5% by weight of hydrocarbon binder 3, as indicated by the examples given in Table 1.

Because of the low relative proportion of hydrocarbon binder, the coated material obtained in this manner will have a moderate cost.

The amount of hydrocarbon binder 3 may also be characterized by the concept of the "richness modulus" K, explained below.

First we introduce the concept of specific surface area of the aggregate, denoted Σ and expressed in m2/kg, which is the exposed surface area that the sphere-like particles will have. For a given particle size distribution, the following formula provides an approximation of the specific surface area Σ:

$$\Sigma=(0.17G+0.33g+2.3S+12s+135f)/100,$$

where:

G: percentage of coarse gravel (diameter>11 mm)

g: percentage of fine gravel (range 6/11 mm)

S: percentage of coarse sand (range 0.3/6 mm)

s: percentage of fine sand (range 0.08/0.3 mm)

f: percentage of filler (diameter<0.08 mm).

This equation can be approximated by:

$$\Sigma=(0.25G+2.3S+12s+150f)/100, \text{ where:}$$

G: percentage of coarse gravel (diameter>6.3)

S: percentage of coarse sand (range 0.25/6.3)

s: percentage of fine sand (range 0.063/0.25)

f: percentage of filler (diameter<0.063), a formula which can be further simplified by approximation, as follows:

$$\Sigma=2.5+1.3f$$

The optimal binder content, denoted 'P', is a function of the specific surface area of the aggregate and is given by the following experimental equation:

$$P=\alpha K^5\sqrt{\Sigma}$$

where:

P: binder content (%)

α: factor dependent on the type of particles (2.65/density of the particles)

Σ: specific surface area of the aggregate (m2/kg)

K: richness modulus

K generally varies from 2.75 for coated materials giving the most strain strength, to 3.5 for the most flexible coated materials.

In order to implement the base layer 5, the coated material 1 is spread on its support (subgrade layer or sub-base layer or possibly base course), then the coated material is compacted with single or multi-axle road rollers as is known in the art.

Resulting Performance

After compacting, a structure is obtained as illustrated in FIGS. 2 and 3, the void content being less than 10%, possibly less than 8%, and preferably less than 6%. For the methods of measuring the compactability in the laboratory, one can refer to standard NF EN12697-31, specifically concerning compactability with the gyratory shear compactor ('GSC') at 100 gyrations for the examples discussed here.

The hydrocarbon binder 3 thoroughly covers the entire surface of the large sized particles 20 (see FIG. 2). The presence and good distribution of the hydrocarbon binder 3 gives good fatigue resistance to the coated material obtained in this way. According to the invention, the fatigue resistance of the coated material once compacted is advantageously greater than 90 microstrain, or possibly 110 microstrain, or possibly even 130 microstrain, with no need to add fibers to the hydrocarbon binder. The measurements of fatigue resistance mentioned here are generally conducted at a temperature of 10° C. and at a frequency of 25 Hz. For methods for measuring fatigue resistance, one can refer to standard NF EN12697-24 for the two-point bending mode on trapezoid test specimens. Standard AASHTO T321 for four-point bending mode on prismatic test specimens is an alternative at 68° F. and 10 Hz, but the limit values for the fatigue resistance are then 250 microstrain, or possibly 500 microstrain, or possibly even 750 microstrain.

Advantageously according to the invention, after compacting, considering the low proportion of binder, the binder having a specific heat coefficient (about 2090 J/Kg/° C.) higher than that of the particles (about 700 J/Kg/° C.), the temperature of the coated material 3 of the invention decreases more quickly than does conventional coated material with a higher binder content, and all the more so as the conductivity of the bitumen (about 0.163 W/m/° C.) is lower than that of the particles (about 0.9 to 2.2 W/m/° C.).

Thus the base layer 5 (or if applicable the binder layer 55) cools faster and is able to receive the surface layer 53 more quickly. As a result, the time required to lay the pavement can be reduced, accelerating the time to completion. This avoids problems of insufficient bearing capacity and cohesion in newly laid asphalt mixes of the prior art, particularly those produced and laid at "hot", "warm", or "moderately warm" temperatures.

For asphalt mixes produced and laid at ambient temperature, generally with "foamed" or "emulsified" binders, the problems of insufficient bearing capacity and cohesion when newly laid are solved by the use of the types of aggregate skeletons described here and by the performances obtained, particularly in terms of compactability and modulus of rigidity.

The performances obtained are represented in the appended Table 2. Table 2 indicates the performances obtained according to the type of binder used (see binder details in Table 6), with the following criteria quantified:

- compactability: this is quantified by a reference test using a gyratory shear compactor GSC according to standard NF EN 12697-31; the results obtained for the void content vary between 4.6% and 10%, which are in accordance with the claimed threshold values of 10%, 8% and 6%,
- modulus of rigidity: this is evaluated according to standard NF EN12697-26 at a temperature of 15° C. and at a frequency of 10 Hz although the values of the modulus of rigidity can also be determined based on standard AASHTO TP 62-03 at 70° F. and 10 Hz; the results obtained vary between 10500 MPa and 18050 MPa, which are in accordance with the claimed threshold values of 9000 MPa, 11000 MPa and 14000 MPa,
- fatigue resistance: according to standard NF EN12697-24, at a temperature of 10° C. and at a frequency of 25 Hz, results are obtained that vary between 108 and 140 microstrain, which conform to the claimed threshold values of 90 microstrain, 110 microstrain, and 130 microstrain.

Second Embodiment

In a second embodiment, the aggregate skeleton is defined by a third particle size fraction (missing) having a lower limit d3=6.3 mm and an upper limit D3=10 mm, the first particle size fraction having for the upper boundary D1=6.3 mm, and the second particle size fraction being identical to that of the first embodiment.

Under these conditions, for the second embodiment of the invention, the width of the third particle size fraction is Delta3=D3−d3=3.7 mm, while the relative width (dimensionless) of the third particle size fraction is Delta3/D2=0.264 which is 26.4%. Similarly, the same ratio between the first median dm1 and the second median dm2 is 2 mm/12 mm, which is 0.166.

Table 3, appended to the end of the present description, provides an example of an aggregate skeleton ('HP5') according to the second embodiment of the invention, compared to a control (second column). In Table 2, one can see that for the example represented, the relative weight of the third particle size fraction (passing through sieves of 6.3 and 10 mm) is 10% which gives a ratio P3/Delta3red=10/26.4=0.378 which satisfies formula Eq. 1 above.

The obtained performances (column 'HP5') are indeed comparable to those obtained in the case of the first embodiment of the invention, illustrated in Table 2. In particular, in this second mode, the modulus of rigidity is 16 800 MPa and the fatigue resistance is 110 microstrain, under the same measurement conditions.

Third Embodiment

In a third embodiment, the aggregate skeleton is defined by the presence of two missing fractions.

With reference to FIG. 5, in addition to the three particle size fractions already described, the aggregate skeleton also comprises:

- a fourth particle size fraction (14) d4/D4 which is then the upper particle size fraction (instead of the second), and
- a fifth particle size fraction (15) d5/D5, between the second and fourth particle size fractions, and which constitutes a second missing fraction.

In the third embodiment, the first particle size fraction has the boundaries d1=0.125 mm and D1=2 mm, the third particle size fraction has the boundaries d3=2 mm and D3=6.3 mm, the second particle size fraction has the boundaries d2=6.3 mm and D2=10 mm, the fifth particle size fraction has the boundaries d5=10 mm and D5=14 mm, and the fourth particle size fraction has the boundaries d4=14 mm and D4=20 mm. Said fifth particle size fraction constitutes a second particle size discontinuity, which in the examples illustrated presents 10 to 12% of the total weight of the coated material.

In the third embodiment, the width of said fifth particle size fraction is greater than 20% of the upper limit D4 (20% here), and the fifth particle size fraction (15) has a ratio (P5) of its weight relative to the weight of the aggregate (2) such that:

$$\frac{P5}{(D5 - d5)/D4} \leq 0.6. \quad \text{(Eq. 4)}$$

Table 4, appended to the present description, gives an example of two aggregate skeletons (denoted 'HP6' and 'HP7') according to the third embodiment of the invention, compared to a control (third column).

The third particle size fraction (first missing fraction) represents, in the two illustrated examples HP6 and HP7, 8% of the total weight of the coated material, and therefore Delta3/D2=8/40=0.20, which is in accordance with equations Eq. 1 to Eq. 3.

The fifth particle size fraction (second missing fraction) represents in the illustrated example HP6 12% of the total weight of the coated material, and therefore Delta5/D4=12/20=0.6, which is in accordance with equation Eq. 4 claimed above. In example HP5, this value is Delta5/D4=10/20=0.5 which also is in accordance with equation Eq. 4 above.

In Table 5, one can see the performances obtained by the coated materials 'HP6' and 'HP7' compared to the performances of the control coated material (third column). Moduli of rigidity greater than 9000 MPa are obtained, of between 12300 MPa and 14000 MPa. Fatigue resistances are obtained that are greater than 90 microstrain, between 109 and 118 microstrain.

The composition of the coated material is thus optimal for the production and application of a base layer.

In addition, it provides excellent compactability and reduces the time required to lay the pavement. Outstanding performance is also obtained concerning the durability and rigidity of the pavement. Lastly, from an ecological point of view, this can minimize the consumption of asphalt of fossil origin and maximize the reuse of recycled aggregate.

It should be noted that the invention is not limited to particular values for the lower and upper bounds d1 to d3 and D1 to D3, or d1 to d3 and D1 to D5, as all values meeting the conditions stated in the main claim in particular are considered as being within the scope of the invention.

It should also be noted that the invention is not limited to a particular geological type of particles. In the first embodiment the particles are predominantly diorite, in the second embodiment the particles are predominantly basalt, and in the third embodiment the particles are predominantly hard limestone.

TABLE 1

Examples of High Performance Coated Materials (HPCM) according to the first embodiment of the invention

| | Examples of High Performance Coated Materials ("HPCM") according to the first embodiment of the invention | | | | Standard control mixes | |
|---|---|---|---|---|---|---|
| | Skeleton HP 1 | Skeleton HP 2 | Skeleton HP 3 | Skeleton HP 4 | Skeleton Control 1 Class 2 | Skeleton Control 2 EME (HiMA) class 2 |
| Recycled aggregate content (%) | 0 | 10 | 0 | 25 | 0 | 0 |
| Sieve size (mm) | Passing through sieve (%) | | | | | |
| 16 | 100 | 100 | 100 | 99 | 100 | 100 |
| 14 | 96 | 96 | 96 | 91 | 97 | 98 |
| 12.5 | 86 | 87 | 86 | 76 | 91 | 93 |
| 10 | 54 | 56 | 53 | 53 | 70 | 75 |
| 8 | 44 | 46 | 43 | 47 | 59 | 64 |
| 6.3 | 43 | 45 | 43 | 45 | 53 | 56 |

TABLE 1-continued

| Examples of High Performance Coated Materials (HPCM) according to the first embodiment of the invention | | | | | | |
|---|---|---|---|---|---|---|
| | Examples of High Performance Coated Materials ("HPCM") according to the first embodiment of the invention | | | | Standard control mixes | |
| | Skeleton HP 1 | Skeleton HP 2 | Skeleton HP 3 | Skeleton HP 4 | Skeleton Control 1 Class 2 | Skeleton Control 2 EME (HiMA) class 2 |
| 4 | 40 | 41 | 40 | 41 | 44 | 45 |
| 3.15 | 38 | 39 | 38 | 38 | 41 | 41 |
| 2 | 33 | 33 | 33 | 31 | 36 | 34 |
| 1 | 23 | 24 | 23 | 23 | 25 | 23 |
| 0.5 | 17 | 18 | 17 | 17 | 17 | 16 |
| 0.25 | 14 | 14 | 13 | 13 | 13 | 12 |
| 0.125 | 11 | 11 | 11 | 11 | 10 | 9 |
| 0.063 | 8.4 | 8.7 | 8.1 | 8.4 | 7.4 | 6.7 |
| Passing through 4 and 10 mm sieves (%) | 14 | 15 | 13 | 12 | 26 | 30 |
| Materials | Content (%) | | | | | |
| 10/14 | 57 | 50.8 | 57.3 | 43 | 36.1 | 29.7 |
| 6/10 | | | | | 12.4 | 15 |
| 4/6 | | | | | 13.5 | 18.9 |
| 0/4 | 14 | 12 | 12.5 | 11 | | |
| 0/2 | 20.6 | 19.5 | 22 | 14 | 32.5 | 30 |
| filler | 4.6 | 4.3 | 4 | 3.5 | 1.7 | 1.3 |
| Recycled 0/14 | | 10 | | 25 | | |
| Added binder | 3.8 | 3.4 | 4.2 | 3.5 | 4.1 | 5.1 |
| Total binder (new + recycled) | 3.8 | 3.9 | 4.2 | 4.8 | 4.1 | 5.1 |
| Richness modulus 'K' | 2.5 | 2.6 | 2.8 | 3.1 | 2.8 | 3.6 |

TABLE 2

| Performances for the High Performance Coated Materials ("HPCM") examples of Table 1 | | | | |
|---|---|---|---|---|
| | Examples of High Performance Coated Materials ("HPCM") according to the first embodiment of the invention | | | |
| | Skeleton HP 1 | Skeleton HP 2 | Skeleton HP 3 | Skeleton HP 4 |
| Recycled aggregate content (%) | 0 | 10 | 0 | 25 |
| Total binder content (new + recycled) | 3.8 | 3.9 | 4.2 | 4.8 |
| Richness modulus 'K' | 2.5 | 2.6 | 2.8 | 3.1 |
| | Compactability 'GSC' (% void content after 100 gyrations) | | | |
| With binder 'BO' | | — | 4.8 | 4.9 |
| With binder 'BM' | 5.8 | 6.8 | 4.6 | 6.1 |
| With binder 'BOM' | 6.0 | 6.0 | 7.0 | 4.9 |
| With binder 'BOM2' | — | — | — | 5.0 |
| With binder 'BE' | — | — | — | 10.0 |
| | Modulus of Rigidity (15° C., 10 Hz) | | | |
| With binder 'BO' | | — | 12 100 | 11 900 |
| With binder 'BM' | 18 050 | 15400 | 16 610 | 15 100 |
| With binder 'BOM' | — | — | — | 11 800 |
| With binder 'BOM2' | — | — | — | 10 500 |
| | Fatigue (10° C., 25 Hz) Microstrain (με) | | | |
| With binder 'BO' | — | — | 115 | 130 |
| With binder 'BM' | — | 110 | 108 | 124 |

TABLE 2-continued

| Performances for the High Performance Coated Materials ("HPCM") examples of Table 1 | | | | |
|---|---|---|---|---|
| | Examples of High Performance Coated Materials ("HPCM") according to the first embodiment of the invention | | | |
| | Skeleton HP 1 | Skeleton HP 2 | Skeleton HP 3 | Skeleton HP 4 |
| With binder 'BOM' | | | | 134 |
| With binder 'BOM2' | | | | 140 |

The information on binders 'BM', 'BO', 'BOM', 'BOM2', 'BE' is in Table 6.

TABLE 3

| Examples of High Performance Coated Materials ("HPCM") according to the second embodiment of the invention | | |
|---|---|---|
| | Skeleton HP5 | Control skeleton 2 GB (bitumen gravel) Class 2 |
| Recycled aggregate content (%) | 20 | 20 |
| Sieve size (mm) | Passing through Sieve (%) | |
| 20 | 100 | 100 |
| 16 | 97 | 98 |
| 14 | 96 | 98 |
| 12.5 | 81 | 91 |
| 10 | 59 | 78 |
| 8 | 52 | 63 |

TABLE 3-continued

| Examples of High Performance Coated Materials ("HPCM") according to the second embodiment of the invention | | |
|---|---|---|
| | Skeleton HP5 | Control skeleton 2 GB (bitumen gravel) Class 2 |
| 6.3 | 49 | 53 |
| 4 | 44 | 46 |
| 3.15 | 42 | 43 |
| 2 | 36 | 37 |
| 1 | 26 | 26 |
| 0.5 | 20 | 18 |
| 0.25 | 15 | 14 |
| 0.125 | 12 | 10 |
| 0.063 | 9.9 | 8.0 |
| Passing through 6.3 and 10 mm sieves (%) | 10 | 25 |
| Materials | Content (%) | |
| 10/14 | 43.4 | 20 |
| 6/10 | | 21 |
| 2/6 | 7 | 8.6 |
| 0/2 | 22.5 | 26 |
| filler | 4 | 1.1 |
| Recycled 0/14 | 20 | 20 |
| Added binder | 3 | 3.3 |
| Type of binder | 'BM' | 'BP' |
| Total binder (new + recycled) | 4.2 | 4.4 |
| Richness Modulus 'K' | 2.8 | 3.0 |
| Performances obtained | | |
| Compactability 'GSC' (Void content % after 100 gyrations) | 7.8 | 8.8 |
| Modulus of Rigidity (15° C., 10 Hz) | 16 800 | 13 600 |
| Fatigue (10° C., 25 Hz) Microstrain (με) | 110 | 89 |

Information on binders 'BP' and 'BM' is in Table 6.

TABLE 4

| Examples of High Performance Coated Materials ("HPCM") according to the third embodiment of the invention | | | |
|---|---|---|---|
| | Skeleton HP6 | Skeleton HP7 | Control skeleton 3 GB (bitumen gravel) Class 2 |
| Recycled aggregate content (%) | 15 | 15 | 15 |
| | Passing through Sieve (%) | | |
| 25 | 100 | 100 | 100 |
| 20 | 99 | 99 | 100 |
| 16 | 82 | 84 | 91 |
| 14 | 69 | 71 | 87 |
| 12.5 | 63 | 66 | 78 |
| 10 | 57 | 61 | 70 |
| 8 | 47 | 51 | 64 |
| 6.3 | 36 | 40 | 57 |
| 4 | 32 | 36 | 41 |
| 3.15 | 31 | 35 | 36 |
| 2 | 28 | 32 | 27 |
| 1 | 20 | 23 | 18 |
| 0.5 | 15 | 17 | 13 |
| 0.25 | 12 | 13 | 10 |
| 0.125 | 10 | 11 | 8 |
| 0.063 | 8.3 | 8.9 | 6.7 |
| Passing through 10 and 14 mm sieves (%) | 12 | 10 | 15 |

TABLE 4-continued

| Examples of High Performance Coated Materials ("HPCM") according to the third embodiment of the invention | | | |
|---|---|---|---|
| | Skeleton HP6 | Skeleton HP7 | Control skeleton 3 GB (bitumen gravel) Class 2 |
| Passing through 2 and 6.3 mm sieves (%) | 8 | 8 | 30 |
| 14/20 | 38.2 | 35.1 | 19.1 |
| 10/14 | | | |
| 6/14 | | | 15 |
| 6/10 | 18.5 | 17.5 | |
| 2/6 | | | 25 |
| 0/2 | 20.8 | 24.8 | 20 |
| filler | 4 | 4 | 2 |
| Added binder | 3.5 | 3.6 | 3.9 |
| Type of binder | 'BO' | 'BO' | 'BP' |
| Total binder (new + recycled) | 4.0 | 4.1 | 4.4 |
| Richness Modulus 'K' | 2.5 | 2.6 | 2.9 |

The information on binders 'BO' and 'BP' is in Table 6.

TABLE 5

| Performances for the examples of High Performance Coated Materials according to the third embodiment of the invention | | | |
|---|---|---|---|
| | Examples of High Performance Coated Materials ("HPCM") according to the first embodiment of the invention | | |
| | Skeleton HP6 | Skeleton HP7 | Control skeleton 3 Class 2 |
| Recycled aggregate content (%) | 15 | 15 | 15 |
| Total binder content (new + recycled) | 4.0 | 4.1 | 4.4 |
| Richness Modulus 'K' | 2.5 | 2.6 | 2.9 |
| | Compactability 'GSC' (Void content % after 100 gyrations) | | |
| With binder 'BP' | — | — | 6.8 |
| With binder 'BO' | 3.8 | 2.8 | — |
| With binder 'BM' | 3.8 | 2.8 | — |
| With binder 'BE' | — | 8.5 | — |
| | Modulus of Rigidity (15° C. 10 Hz) | | |
| With binder 'BP' | — | — | 11 800 |
| With binder 'BO' | 13 000 | 12 300 | — |
| With binder 'BM' | 14 000 | 12 900 | — |
| | Fatigue (10° C., 25 Hz) Microstrain (με) | | |
| With binder 'BP' | — | — | 87 |
| With binder 'BO' | 114 | 118 | — |
| With binder 'BM' | 109 | 111 | — |

Information on binders 'BP', 'BM', 'BO', 'BE' is in Table 6.

TABLE 6

Characteristics of binders used in the various embodiment examples

| | Characteristics of binders used in the various embodiments | | | |
|---|---|---|---|---|
| | Type | Origin | Penetrability (*) | Usage temperature |
| Binder 'BP' | pure asphalt | binder 35/50 from the BP Lavéra refinery | 38 | hot |
| | | The 'BP' binder is the one used in the prior art reference asphalt mixes | | |
| Binder 'BO' | "oxidized" asphalt | multigrade (industrial) binder 35/50 from the BP Lavéra refinery | 37 | hot |
| Binder 'BM' | "modified" asphalt | binder 35/50 from the BP Lavéra refinery + 2.5% cross-linked SBS polymer | 36 | hot |
| Binder 'BOM' | "oxidized" and "modified" asphalt | multigrade (industrial) binder 35/50 from the BP Lavéra refinery + 2.5% cross-linked SBS polymer | 30 | hot |
| Binder 'BOM2' | "oxidized" and "modified" asphalt | binder 100/150 from the BP Lavéra refinery + 6% cross-linked SBS polymer | 62 | hot |
| Binder 'BE' | "emulsified" asphalt | 60% bitumen 160/220 BP Lavéra, 38.5% water 0.6% "Indulin GE 7" surfactant (Meadwestvaco) 0.6% "Redicote 4875" surfactant (Akzo) 0.3% HCl (hydrochloric acid) | 185 | Ambient (20° C.) |

(*) Penetrability expressed in tenths of millimeters (pens), as defined in standard EN 1426 (or ASTM Method D5) under standard test conditions, specifically at 25° C./77° F.
As for the binder 'BE', this penetrability is for the bitumen before treatment.

The invention claimed is:

1. A coated material for a base layer or binder layer of a road or highway pavement, or for industrial, port, or airport platforms, or for a supporting layer for railroad tracks, wherein said coated material is composed of aggregate mixed with at least one hydrocarbon binder, wherein the aggregate represents more than 95% by weight of the coated material, and the hydrocarbon binder represents at most 5%, wherein the aggregate comprises a granular structure comprising several particle size fractions d/D, each particle size fraction being defined by a lower limit (d) and an upper limit (D), wherein the aggregate comprises a first particle size fraction d1/D1 having as median a first median dm1, and a second particle size fraction d2/D2 having as median a second median dm2, wherein the aggregate comprises a third particle size fraction d3/D3 between the first and second particle size fractions, having as lower limit d3 the upper limit D1 of the first particle size fraction, and having as upper limit D3 the lower limit d2 of the second particle size fraction, wherein the third particle size fraction has a ratio (P3) of its weight relative to the weight of the aggregate, wherein the width of the third particle size fraction D3−d3, defining a relative width (D3−d3)/D2 in relation to the upper limit (D2) of the second particle size fraction, said relative width being greater than 20% of D2, wherein the ratio of the weight ratio (P3) of the third particle size fraction and its relative width is less than 0.4, which is:

$$\frac{P3}{(D3-d3)/D2} \leqslant 0.4$$

by means of which the number of contacts between the particles of the second particle size fraction d2/D2 is maximized, wherein the coated material comprises, after compacting, a void content of less than 10%, wherein the hydrocarbon binder is a hydrocarbon binder modified by inclusion of polymers and/or oil, and/or treated by blowing and/or treated by foaming or by emulsion, by means of which the modulus of rigidity of the coated material, once compacted, is greater than 9000 MPa at a temperature of 15° C. and at a frequency of 10 Hz, and the fatigue resistance of the coated material, once compacted, is greater than 90 microstrain at a temperature of 10° C. and at a frequency of 25 Hz.

2. The coated material according to claim 1, wherein the ratio between the first median dm1 and the second median dm2 is less than 0.33.

3. The coated material according to claim 1, wherein the width of the third particle size fraction D3−d3 is greater than 30% of D2−d1.

4. The coated material according to claim 1, wherein the ratio between the weight ratio (P3) of the third particle size fraction and its relative width is less than 0.25, which is:

$$\frac{P3}{(D3-d3)/D2} \leqslant 0.25$$

5. The coated material according to claim 1, wherein the ratio between the weight ratio (P3) of the third particle size fraction and its relative width is greater than 0.10, which is:

$$\frac{P3}{(D3-d3)/D2} \geqslant 0.10$$

6. The coated material according to claim 1, wherein the hydrocarbon binder has a needle penetration depth, measured at 25° C. as defined in standard EN 1426, that is greater than 30 tenths of a mm.

7. The coated material according to claim 1, wherein the fatigue resistance of the coated material, once compacted, measured at a temperature of 10° C. and at a frequency of 25 Hz according to standard NF EN12697-24, is greater than 110 microstrain.

8. The coated material according to claim 1, wherein the modulus of rigidity of the coated material, once compacted, measured at a temperature of 15° C. and at a frequency of 10 Hz according to standard NF EN12697-26, is greater than 11000 MPa.

9. The coated material according to claim 1, wherein the hydrocarbon binder is without fibers.

10. The coated material according to claim 1, additionally comprising a fourth particle size fraction d4/D4 and a fifth particle size fraction d5/D5 between the second and fourth particle size fractions, having for lower limit d5 the upper limit D2 of the second particle size fraction, and having for upper limit D5 the lower limit d4 of the fourth particle size fraction, wherein the width of the fifth particle size fraction is greater than 20% of the upper limit D4, wherein the fifth particle size fraction has a weight (P5) relative to the weight of the aggregate such that $$\frac{P5}{(D5-d5)/D4} \leq 0.6$$

11. The coated material according to claim 1, wherein the proportion by weight of the hydrocarbon binder in the coated material is at most equal to 4.5%.

12. A pavement comprising at least one base layer or binder layer comprising a coated material according to claim 1.

13. A method for producing a coated material for a base layer or binder layer for road or highway pavement, or for industrial, port, or airport platforms, or for a supporting layer for railroad tracks, said coated material being composed of aggregate mixed with at least one hydrocarbon binder, wherein the aggregate comprises a granular structure comprising several particle size fractions d/D, each particle size fraction being defined by a lower limit and an upper limit, said method comprising the following steps:

a—providing:

particles of a first particle size fraction d1/D1, particles of a second particle size fraction d2/D2, said first and second particle size fractions being separated by a third particle size fraction d3/D3 having as lower limit d3 the upper limit D1 of the first particle size fraction, and having as upper limit D3 the lower limit d2 of the second particle size fraction, wherein the third particle size fraction has a ratio (P3) of the weight relative to the weight of the aggregate, wherein the width of the third particle size fraction D3−d3, defining a relative width (D3−d3)/D2 in relation to the upper limit (D2) of the second particle size fraction, said relative width being greater than 20% of D2, wherein the ratio between the weight ratio (P3) of the third particle size fraction and its relative width is less than 0.4, which is:

$$\frac{P3}{(D3-d3)/D2} \leq 0.4$$

b—adding a hydrocarbon binder to the aggregate until obtaining a total hydrocarbon binder of less than 5% by weight of the coated material, the hydrocarbon binder being a hydrocarbon binder modified by inclusion of polymers and/or oil, and/or treated by blowing and/or treated by foaming or by emulsion, c—mixing the aggregate and hydrocarbon binder together.

14. The method according to claim 13, wherein the first and second particle size fractions comprise a proportion of recycled aggregate, and wherein the total hydrocarbon binder comprises a portion of new hydrocarbon binder and a portion of hydrocarbon binder issuing from recycled aggregate.

15. The method according to claim 13, further comprising the following steps:

d—the coated material is spread on a surface, e—said coated material is compacted, by means of which the coated material comprises a void content of less than 10% and by means of which the modulus of rigidity of the coated material is greater than 9000 MPa at a temperature of 15° C. and at a frequency of 10 Hz, and the fatigue resistance of the coated material is greater than 90 microstrain at a temperature of 10° C. and at a frequency of 25 Hz.

16. The coated material according to claim 1, wherein the coated material comprises, after compacting, a void content of less than 8%.

17. The coated material according to claim 1, wherein the coated material comprises, after compacting, a void content of less than 6%.

18. The coated material according to claim 1, wherein the ratio between the first median dm1 and the second median dm2 is less than 0.25.

19. The coated material according to claim 1, wherein the width of the third particle size fraction D3−d3 is greater than 40% of D2−d1.

20. The coated material according to claim 1, wherein the fatigue resistance of the coated material, once compacted, measured at a temperature of 10° C. and at a frequency of 25 Hz according to standard NF EN12697-24, is greater than 130 microstrain.

21. The coated material according to claim 1, wherein the modulus of rigidity of the coated material, once compacted, measured at a temperature of 15° C. and at a frequency of 10 hz according to standard NF EN12697-26, is greater than 14000 MPa.

22. The method according to claim 15, wherein the coated material comprises a void content of less than 8%.

23. The method according to claim 15, wherein the coated material comprises a void content of less than 6%.

* * * * *